US012578146B2

(12) United States Patent
Kaneko et al.

(10) Patent No.: US 12,578,146 B2
(45) Date of Patent: Mar. 17, 2026

(54) HEAT EXCHANGER

(71) Applicant: SANDEN CORPORATION, Isesaki (JP)

(72) Inventors: Akira Kaneko, Isesaki (JP); Naotaka Iwasawa, Isesaki (JP); Akihiro Fujiwara, Isesaki (JP)

(73) Assignee: SANDEN CORPORATION, Isesaki (JP)

( * ) Notice: Subject to any disclaimer, the term of this patent is extended or adjusted under 35 U.S.C. 154(b) by 368 days.

(21) Appl. No.: 18/040,259

(22) PCT Filed: Aug. 24, 2021

(86) PCT No.: PCT/JP2021/030900
§ 371 (c)(1),
(2) Date: Feb. 1, 2023

(87) PCT Pub. No.: WO2022/045094
PCT Pub. Date: Mar. 3, 2022

(65) Prior Publication Data

US 2023/0272977 A1 Aug. 31, 2023

(30) Foreign Application Priority Data

Aug. 25, 2020 (JP) ..... 2020-141594

(51) Int. Cl.
*F28D 1/053* (2006.01)
*F28F 9/02* (2006.01)
*F28F 1/12* (2006.01)

(52) U.S. Cl.
CPC ..... *F28D 1/05375* (2013.01); *F28D 1/05358* (2013.01); *F28F 9/0221* (2013.01); *F28F 9/0224* (2013.01); *F28F 1/126* (2013.01)

(58) Field of Classification Search
CPC ..... F28D 1/05375; F28D 1/05358; F28F 9/0224; F28F 9/0221; F28F 1/126
(Continued)

(56) References Cited

U.S. PATENT DOCUMENTS 4,846,268 A * 7/1989 Beldam ..... B21D 53/02 165/DIG. 464
2005/0247443 A1* 11/2005 Kim ..... F28D 1/05391 165/176

(Continued)

FOREIGN PATENT DOCUMENTS

CN 101738009 A 6/2010
DE 19649129 A1 5/1998

(Continued)

OTHER PUBLICATIONS

International Search Report mailed Oct. 5, 2021 for International Application No. PCT/JP2021/030900.

(Continued)

*Primary Examiner* — Joel M Attey
(74) *Attorney, Agent, or Firm* — Baker Botts L.L.P.

(57) ABSTRACT

A heat exchanger includes a pair of headers, and a plurality of heat exchanger tubes stacked between the pair of headers. Each of the headers includes header members each having a gutter-shaped cross section and including an open part and a bottom part. The header members are stacked in a staking direction of the heat exchanger tubes in such a way that the bottom part of one header member closes the open part of another header member. A fitted hole into which an end of a heat exchanger tube is fitted is provided in a side part of the header member.

9 Claims, 23 Drawing Sheets

(58) Field of Classification Search
USPC ..... 165/174
See application file for complete search history.

(56) References Cited

U.S. PATENT DOCUMENTS

| | | | | |
|---|---|---|---|---|
| 2007/0039717 | A1* | 2/2007 | Inagaki | H01L 23/473 165/172 |
| 2020/0158388 | A1* | 5/2020 | Vreeland | F25B 39/022 |

FOREIGN PATENT DOCUMENTS

| | | | |
|---|---|---|---|
| DE | 112014001996 | T5 | 12/2015 |
| EP | 1870658 | A1 | 12/2007 |
| FR | 2962200 | A1 | 1/2012 |
| GB | 2078361 | A | 1/1982 |
| JP | 55-050475 | U | 4/1980 |
| JP | 2009-210141 | A | 9/2009 |
| JP | 2018-169062 | A | 11/2018 |
| WO | 2020/189490 | A1 | 9/2020 |

OTHER PUBLICATIONS

German Patent and Trade Mark Office, Office Action issued in German Patent Application No. 11 2021 003 242.9 on Sep. 12, 2025 (9 pages).
The State Intellectual Property Office of the People's Republic of China, The First Office Action issued in Chinese Patent Application No. 202180056623.9, dated Nov. 21, 2025 (12 pages).

* cited by examiner

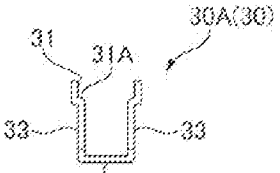
FIG. 3C1
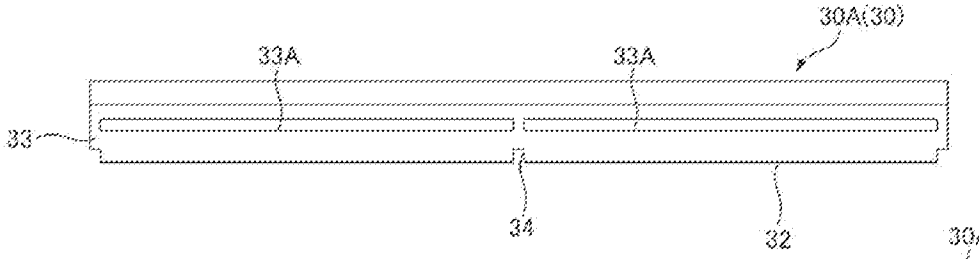
FIG. 3A1
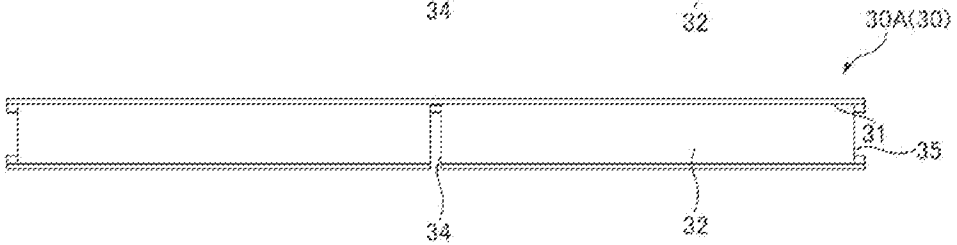
FIG. 3B1
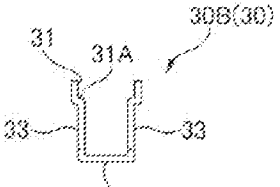
FIG. 3C2
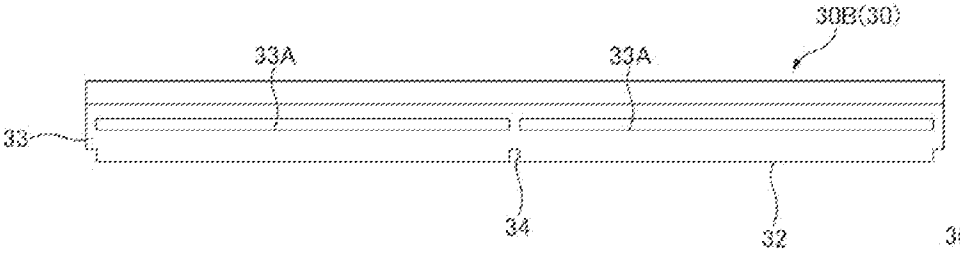
FIG. 3A2
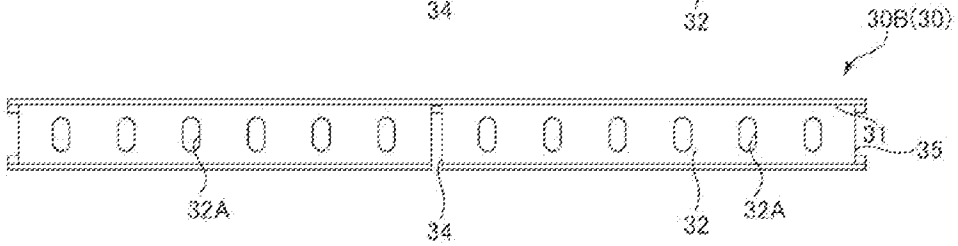
FIG. 3B2

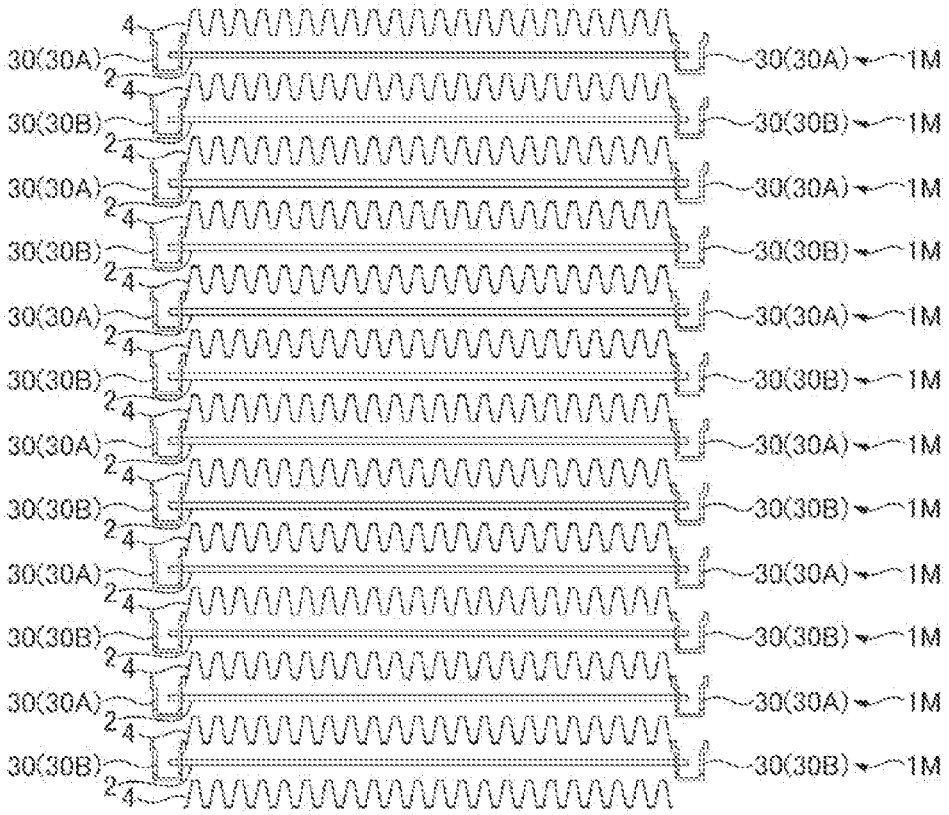
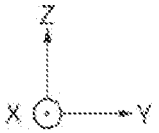
*FIG. 6*

FIG. 9A
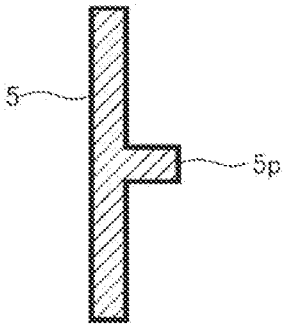
FIG. 9B
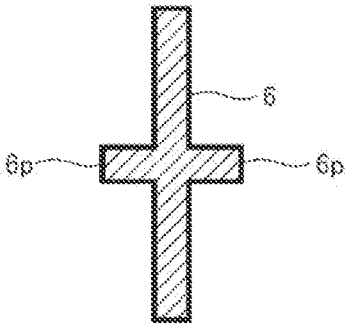
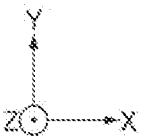

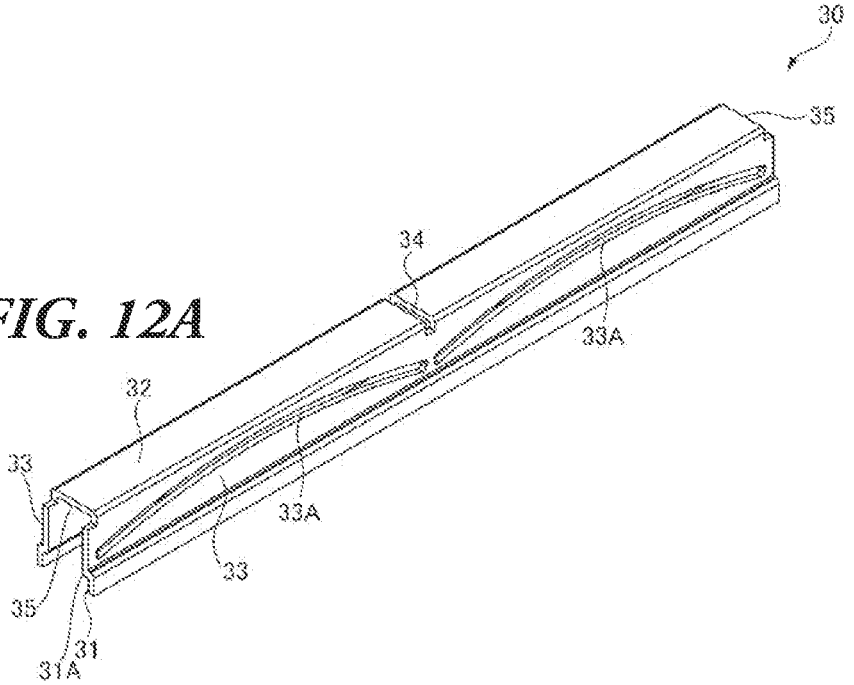
FIG. 12A
FIG. 12B
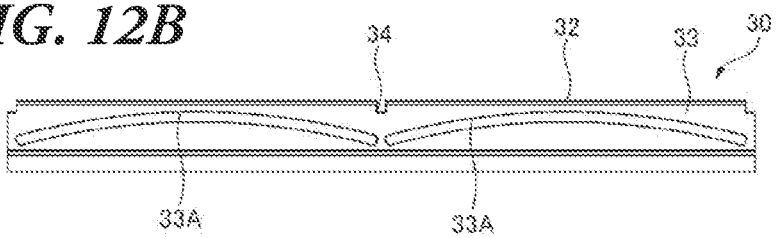
FIG. 12C
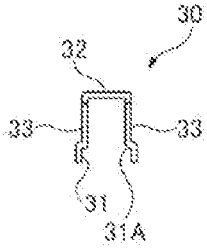
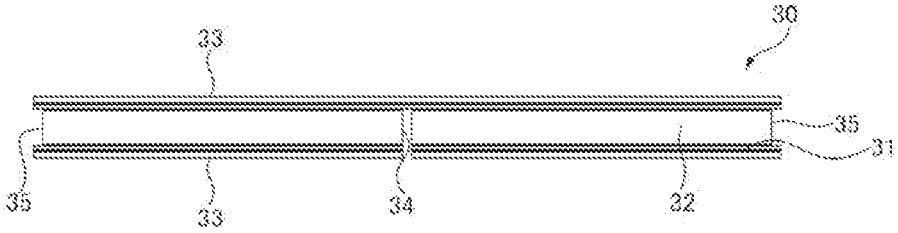
FIG. 12D

HEAT EXCHANGER

TECHNICAL FIELD

The present invention relates to a heat exchanger.

BACKGROUND ART

A heat exchanger such as a radiator, an evaporator, a condenser, and a heater core includes heat exchanger tubes each having a flat cross section to increase the surface area, and performs a heat exchange between heat medium such as a refrigerant flowing through the heat exchanger tubes and fluid (for example, air) around the heat exchanger tubes, via the surfaces of the heat exchanger tubes or heat exchanger fins contacting the surfaces of the heat exchanger tubes. In this heat exchanger, reservoir members referred to as "headers" (or "header tanks") in which the flowed heat medium is accumulated are coupled to the ends of the heat exchanger tubes, and the heat medium flows into and out of the heat exchanger tubes via the headers (see, for example, Patent Literature 1 mentioned below).

CITATION LIST

Patent Literature

PTL1: Japanese Patent Application Laid-Open No. 2009-210141

SUMMARY OF INVENTION

Problem to be Solved by the Invention

The above-described heat exchanger is able to increase its heat exchange area relative to the overall size of the heat exchanger by decreasing the headers in size, and therefore to improve the heat exchange performance with the compact size.

However, the conventional heat exchanger has a header structure in which the longitudinal direction of the header is orthogonal to the longitudinal direction of the cross section across the width of the flat heat exchanger tube (the width direction of the heat exchanger tube), and a plurality of holes into which the flat heat exchanger tubes are inserted are provided along the longitudinal direction of the header. In addition, the header has an approximately ring-shaped structure, and therefore the dimension of the header needs to be greater than that of a tube in the width direction of the tube. Therefore, the greater the dimension of the tube in the width direction of the tube is, the greater the dimension of the header across the width of the tube is. Accordingly, the thickness of the header cannot help being increased in view of the pressure strength, and therefore the volume of the headers is increased in the heat exchanger. As a result, the heat exchange area relative to the overall size of the heat exchanger is reduced, and consequently the heat exchange performance is decreased. Then, in order to enlarge the heat exchange area to address this problem, when the dimension of the heat exchanger tube in the width direction is increased, the problem is further actualized.

Moreover, the conventional heat exchanger has a header structure in which the heat exchanger tubes are stacked along the longitudinal direction of the header. Therefore, in order to change the size of the heat exchanger by increasing the number of stacking of the heat exchanger tubes, there is need to prepare a header with a change in length every time the size of the heat exchanger is changed. Therefore, the size of the heat exchanger is not easily changed, and this causes a problem that it is difficult to optionally adjust the size of the heat exchanger in consideration of the installation space.

The present invention has been proposed to address the above-described problems. It is therefore an object of the invention to enlarge the heat exchange area relative to the overall size of the heat exchanger by decreasing the headers in size, regardless of the dimension of the heat exchanger tube in the width direction, and to make it possible to easily and optionally change the size of the heat exchanger, and consequently to ease the size adjustment of the heat exchanger to fit the installation space.

Solution to Problem

To solve the above-described problem, the invention provide a heat exchanger including: a heat exchanger includes: a pair of headers; and a plurality of heat exchanger tubes stacked between the pair of headers. Each of the headers include header members each having a gutter-shaped cross section and including an open part and a bottom part. The header members are stacked in a staking direction of the heat exchanger tubes in such a way that the bottom part of one header member closes the open part of another header member. A fitted hole into which an end of a heat exchanger tube is fitted is provided in a side part of the header member.

Effect of the Invention

According to the invention, the heat exchanger with the above-described features can decrease the headers in size, regardless of the dimension of the heat exchanger tube in the width direction, and enlarge the heat exchange area relative to the overall size of the heat exchanger. In addition, according to the invention, the heat exchanger with the above-described features can easily and optionally change the size of the heat exchanger by changing the number of stacking of the header members, and therefore easily adjust the size of the heat exchanger to fit the installation space.

BRIEF DESCRIPTION OF DRAWINGS

FIG. 3A1 is a side view illustrating a first header member;

FIG. 3B1 is a plan view illustrating the first header member;

FIG. 3C1 is a front view illustrating the first header member;

FIG. 3A2 is a side view illustrating a second header member;

FIG. 3B2 is a plan view illustrating the second header member;

FIG. 3C2 is a front view illustrating the second header member;

FIG. 6 illustrates an assembly of the heat exchanger (arrangement of heat exchanger modules and fins);

FIG. 9A is a cross-sectional view illustrating the insertion type cap;

FIG. 9B is a cross-sectional view illustrating the insertion type partition;

FIG. 12A is a perspective view illustrating another configuration example of the header member;

FIG. 12B is a side view illustrating another configuration example of the header member;

FIG. 12C is a front view illustrating another configuration example of the header member;

FIG. 12D is a bottom view illustrating another configuration example of the header member;

DESCRIPTION OF EMBODIMENTS

Figure 1:
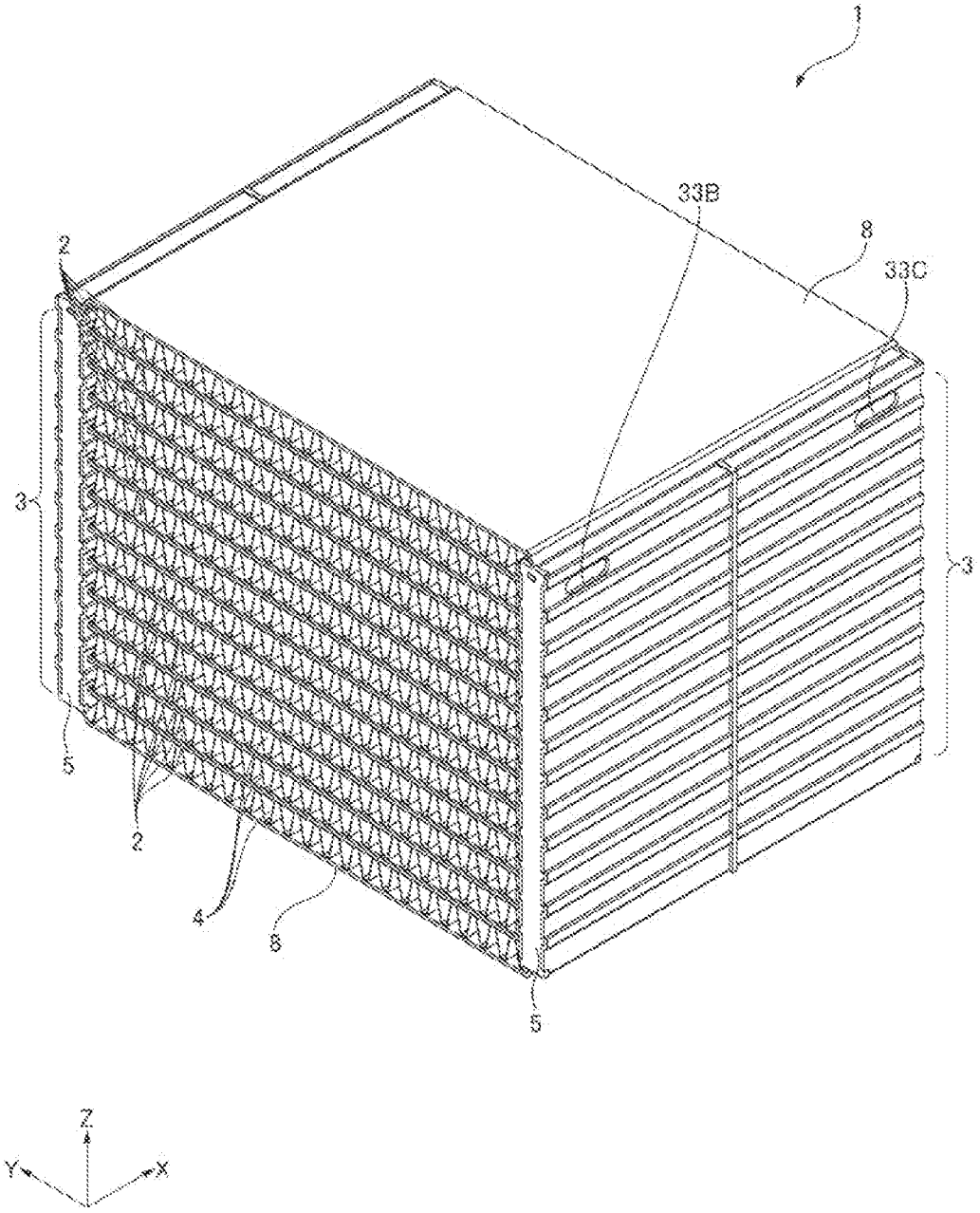
FIG. 1 is an external perspective view illustrating an example of a heat exchanger.

Hereinafter, embodiments of the invention will be described with reference to the drawings. In the description below, the same reference number in different drawings denotes the same component with the same function, and duplicate description for each of the drawings is omitted accordingly. X, Y, and Z directions of arrows in the drawings denote different directions orthogonal to each other. Note that the directions have no relation to the direction of the gravity unless the relation to the direction of the gravity is indicated. In addition, in the description below, "upper" and "lower" are words for illustration but do not mean the upper and the lower in the direction of the gravity.

As illustrated in FIG. 1, a heat exchanger 1 includes a plurality of heat exchanger tubes 2, and a pair of headers 3 coupled to the ends of the heat exchanger tubes 2, respectively. With the illustrated example, each of the heat exchanger tubes 2 has a flat cross section, and includes a flow path through which heat medium is flowed. The heat exchanger tube 2 has the flat cross section which is long along the X direction, and extends to flow the heat medium along the Y direction.

The headers 3 are reservoir flow paths configured to allow the heat medium to flow into each of the stacked heat exchanger tubes 2 or allow the heat medium to flow out of the heat exchanger tubes 2. Each of the headers 3 has a structure in which a plurality of header members 30 illustrated in FIG. 2 are stacked.

Figure 2:
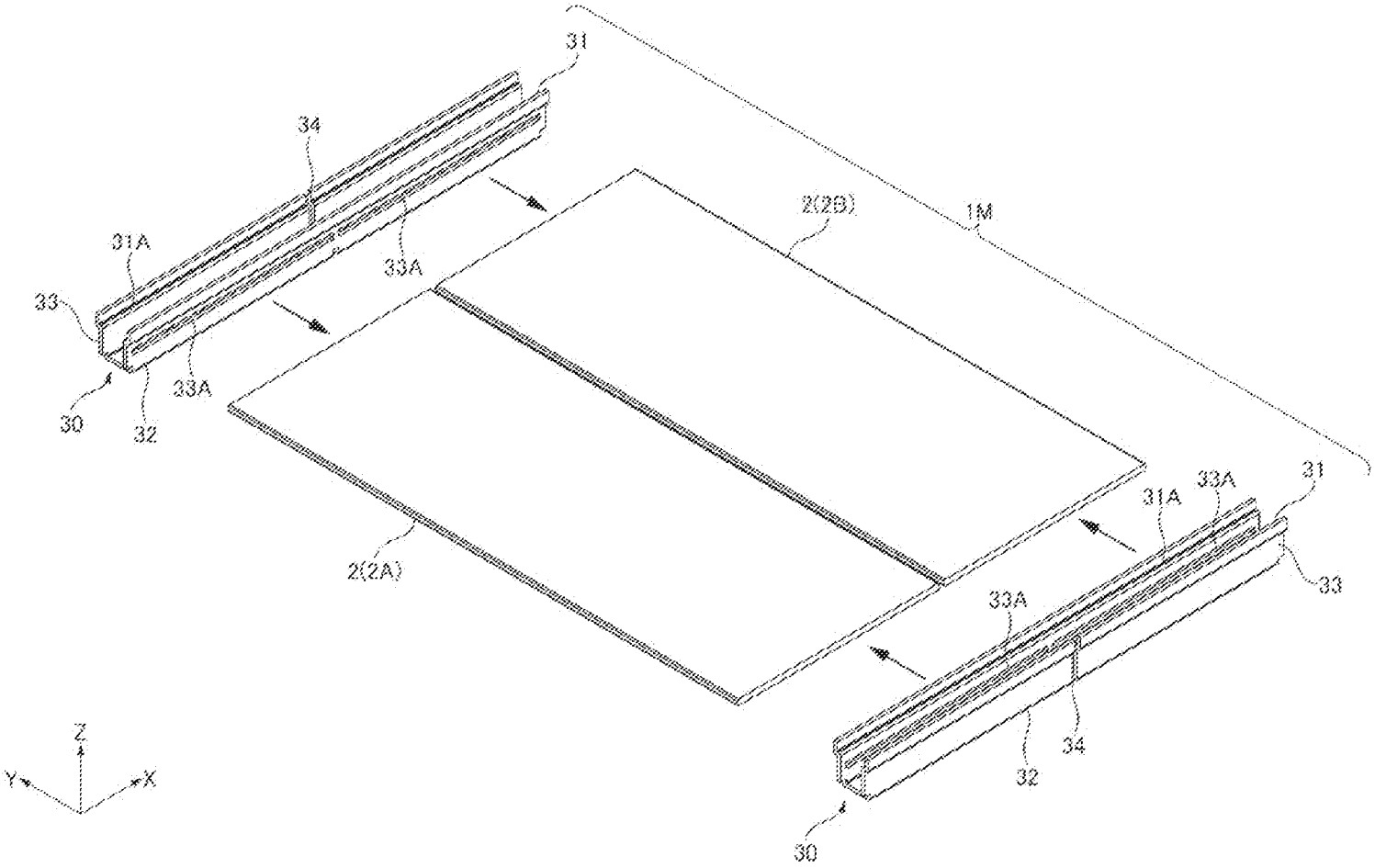
FIG. 2 is an exploded perspective view illustrating one set of heat exchanger module.

As illustrated in FIG. 2, each of the header members 30 has a gutter-shaped cross section (approximately U-shaped cross section), includes an open part 31, a bottom part 32, and side parts 33, and extends in the longitudinal direction of the flat cross section of the heat exchanger tube 2 (the X direction).

In the heat exchanger 1, the header members 30 are coupled to the both ends of the heat exchanger tube 2, respectively, to form one heat exchanger module 1M, as illustrated in FIG. 2. The heat exchanger unit 1M includes the heat exchanger tube 2 between the pair of header members 30, and a plurality of heat exchanger units 1M are stacked to constitute the heat exchanger 1.

As illustrated in FIG. 2, one set of heat exchanger module 1M includes two heat exchanger tubes 2 (2A, 2B) arranged parallel to one another in the longitudinal direction of the flat cross section (the X direction). The ends of each of the heat exchanger tubes 2 (2A, 2B) are fitted into fitted holes 33A provided in the side parts 33 of the header members 30, respectively. Here, one set of heat exchanger module 1M includes two heat exchanger tubes 2 (2A, 2B), but may be constituted by one heat exchanger tube 2.

The header member 30 is formed to provide a flow path of the heat medium in the header 3. With an example illustrated in FIG. 3, the header member 30 includes a first header member 30A illustrated in the side view (3A1; a1), the plan view (3B1; b1), and the front view (3C1; c1), and a second header member 30B illustrated in the side view (3A2; a2), the plan view (3B2; b2), and the front view (3C2; c2).

The first header member 30A is formed such that there is no communication portion in the bottom part 32, that is, the bottom part 32 separates between the stacked header members 30. The second header member 30B is formed such that communication portions (communication holes) 32A is provided in the bottom part 32, that is, the stacked header members 30 communicate with each other via the communication portions 32A of the bottom part 32.

In order to be coupled with more than one (two in the example illustrated in FIG. 2) heat exchanger tubes (2A, 2B), the header member 30 includes the fitted holes 33A which are arranged side by side in the side part 33 along the longitudinal direction of the header member 30 (the X direction). In addition, a partition groove 34 is provided between the fitted holes 33A and is inserted a partition configured to separate the interior of the header member 30. FIG. 2 illustrates the example where one heat exchanger module 1M includes two heat exchanger tubes 2(2A, 2B). However, when two or more heat exchanger tubes 2 are provided, the plurality of fitted holes 33A are provided along the longitudinal direction of the header member 30, and the partition groove 34 is appropriately provided each between the adjacent fitted holes 33A depending on the formation of flow paths. Meanwhile, when one heat exchanger module 1M includes one heat exchanger tube 2, the above-described partition groove 34 is not needed.

In order to constitute the header 3, the header members each having the gutter-shaped cross section (approximately U-shaped cross section) and including the open part 31 and the bottom part 32 are stacked in the stacking direction of the heat exchanger tubes 2 in such a way that the open part 31 of one header member 30 is closed with the bottom part 32 of another header member 30. With the example illustrated in FIG. 4, the open part 31 of the header member 30 includes step portions 31A in which the bottom part 32 closing the open part 31 is fitted.

Figure 4:
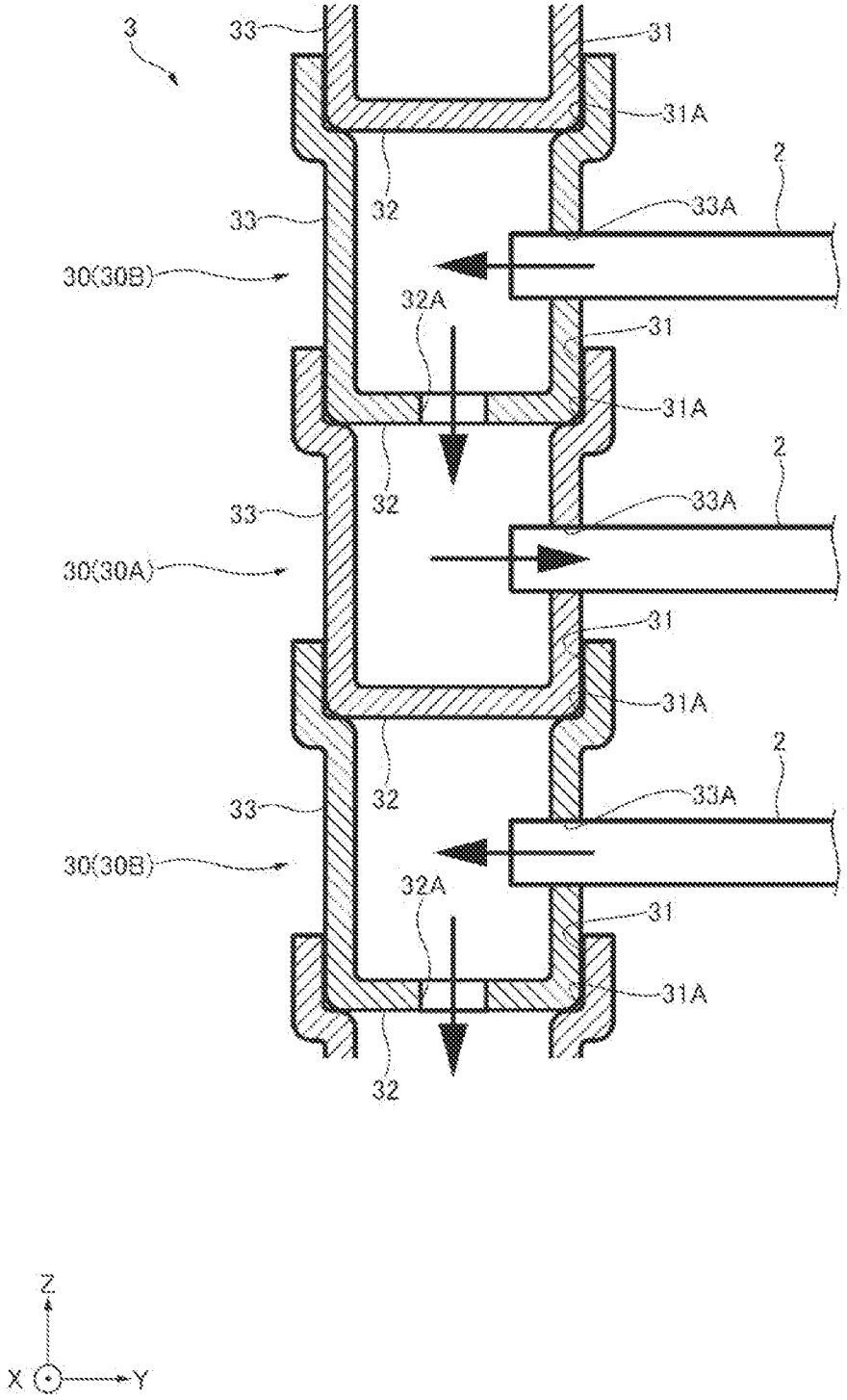
FIG. 4 illustrates a stacked state of header members and the flow of heat medium passing through heat exchanger tubes in a header.
Figure 5A:
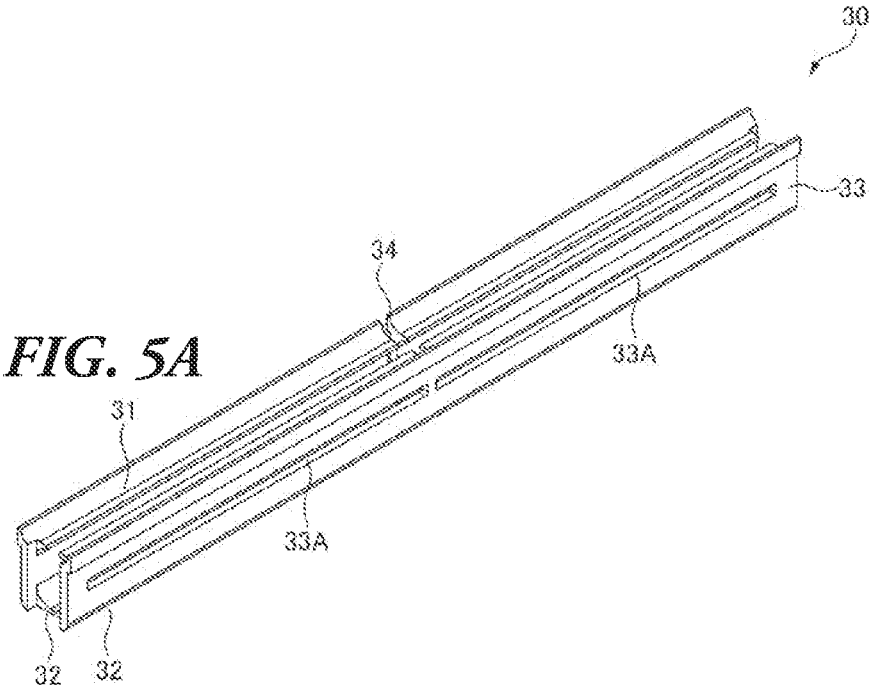
FIG. 5A illustrates another configuration example of the header member.
Figure 5B:
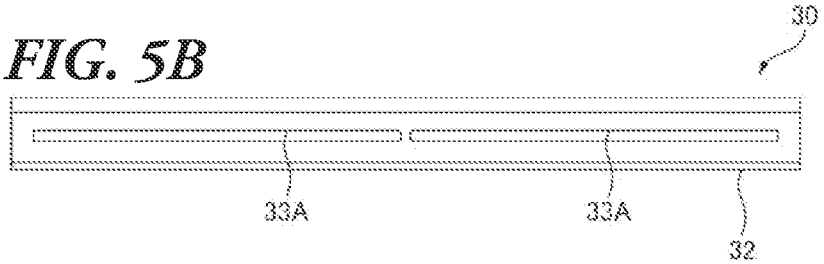
FIG. 5B illustrates another configuration example of the header member.
Figure 5C:
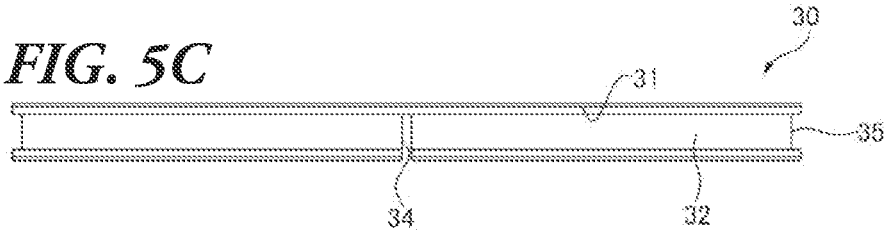
FIG. 5C illustrates another configuration example of the header member.
Figure 5D:
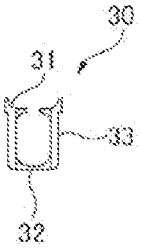
FIG. 5D illustrates another configuration example of the header member.

When the header members 30 are stacked, the first header members 30A and the second header members 30B are alternately stacked. By this means, it is possible to make the flow of the heat medium passing through the communication portions 32A, as illustrated in FIG. 4. In taking notice of the flow of the heat medium, the input end of the heat exchanger tube 2 into which the heat medium flows is fitted into the fitted hole 33A of the first header member 30A having the bottom part 32 which separates between the stacked header members 30. Meanwhile, the output end of the heat exchanger tube 2 from which the heat medium flows out is fitted into the fitted hole 33A of the second header member 30B having the bottom part 32 with the communication portion 32A.

The header member 30 may be manufactured by press forming, roll forming, or extrusion of a metal plate. FIG. 5 illustrates an example of the header member 30 made of an extruded material. By this means, it is possible to change the thickness of the cross section of the header member 30 in the longitudinal direction depending on locations. Specifically, the thickness of a part with a low pressure resistance due to its structure can be increased to enhance the pressure strength.

When the heat exchanger 1 is assembled, the heat exchanger modules 1M and the fins 4 are alternately stacked as illustrated in FIG. 6, and then the header members 30 stacked as illustrated in FIG. 4 are mounted.

Figure 7:
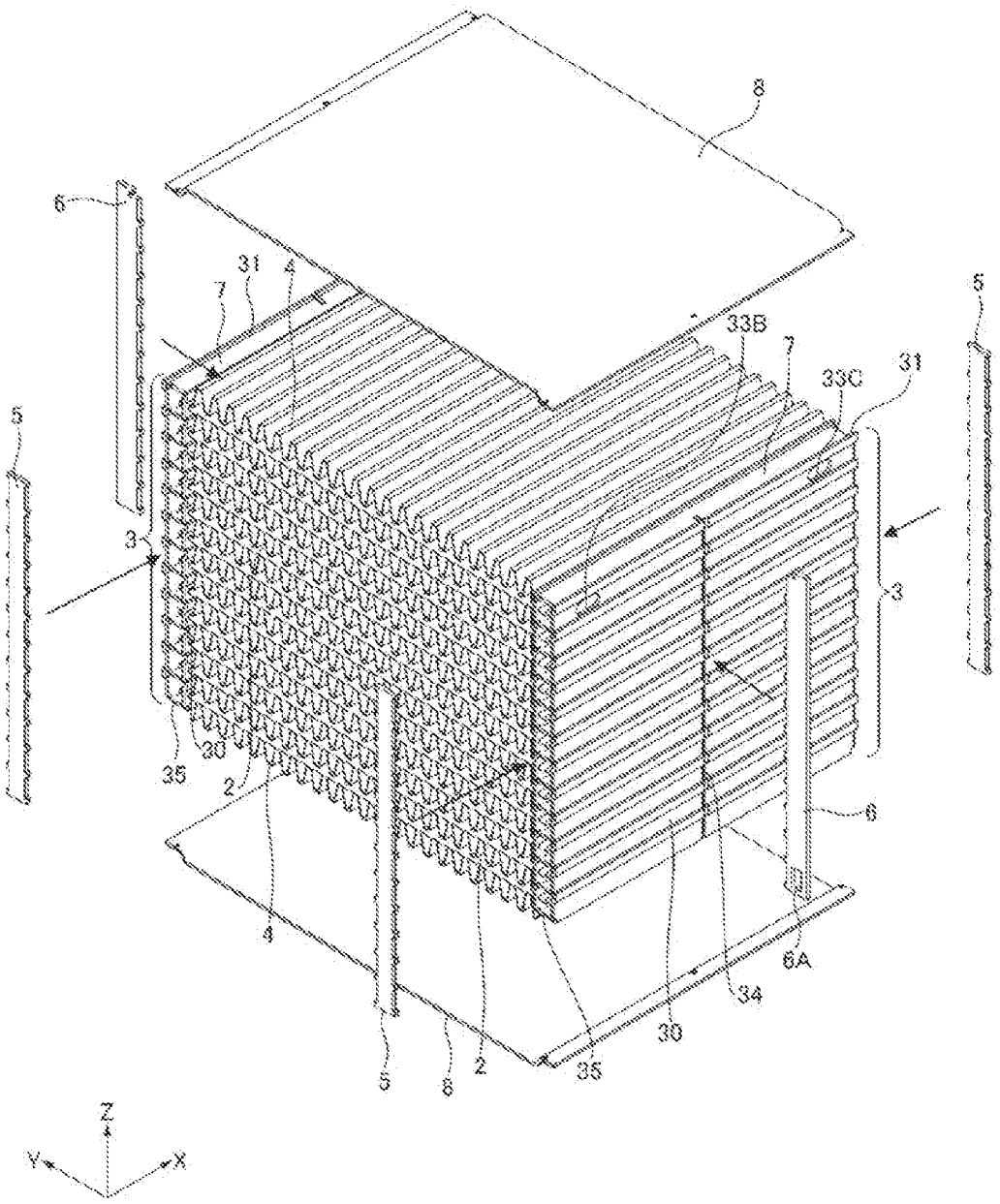
FIG. 7 illustrates an assembly of the heat exchanger (mounting of caps, partitions, header covers, and side plates)

After the header members 30 are mounted, caps 5 are attached to the ends of the header members 30 thus stacked and attached, in the longitudinal direction to close the both ends of the header members 30 as illustrated in FIG. 7. Each of the caps 5 is a plate-like member extending in the staking direction (the Z direction) of the header members 30, and fitted in fitted parts 35 (see FIG. 3) provided in the header members 30.

In addition, after the header members 30 are mounted, partitions 6 are fitted into the partition grooves 34 of the header members 30 as illustrated in FIG. 7. Each of the partitions 6 is a plate-like member extending in the staking direction (the Z direction) of the header members 30, and is configured to separate the interior of the header member 30 in the longitudinal direction of the header member 30.

With the example illustrated in FIG. 7, the partition 6 includes a communication port 6A to form the flow path of the heat medium. The communication port 6A allows the sections of the header member 30 made by the partition 6 in the longitudinal direction to partially communicate with one another. With the illustrated example, a heat medium inlet 33B and a heat medium outlet 33C are provided in the side part 33 of the top header member 30, and the communication port 6A is provided in the bottom header member 30 to allow communication between the sections made by the partition 6.

With the example illustrated in FIG. 7, the heat medium having flowed from the heat medium inlet 33B passes through the left section of the header member 30 (in which the heat medium inlet 33B is provided) separated by the partition 6 in the longitudinal direction of the header member 30; flows through the stacked heat exchanger tubes 2 from above to below as illustrated in FIG. 4; passes through the communication port 6A provided in the bottom header member 30; flows through the right section of the header member 30 (in which the heat medium inlet 33C is provided) separated by the partition 6 in the longitudinal direction of the header member 30; flows through the stacked heat exchanger tubes 2 from below to above; and flows out of the heat medium outlet 33C.

With the example illustrated in FIG. 7, the open part 31 of the top one of the stacked header members 30 of each of the headers 3 is closed with the header cover 7. The header cover 7 is a plate-like member extending in the longitudinal direction of the header member 30. Meanwhile, side plates 8 are mounted to the top one and the bottom one of the stacked heat exchanger modules 1M as needed.

With the example illustrated in FIG. 7, coupling members (not shown) for connecting pipes are provided in the heat medium inlet 33B and the heat medium outlet 33C in the side part 33 of the top one of the stacked header members 33 of each of the headers 3.

With the example illustrated in FIG. 7, all the parts are mounted as illustrated in FIG. 1, and then, each of the mounted components such as the header members 30 is bonded by brazing.

Figure 8:
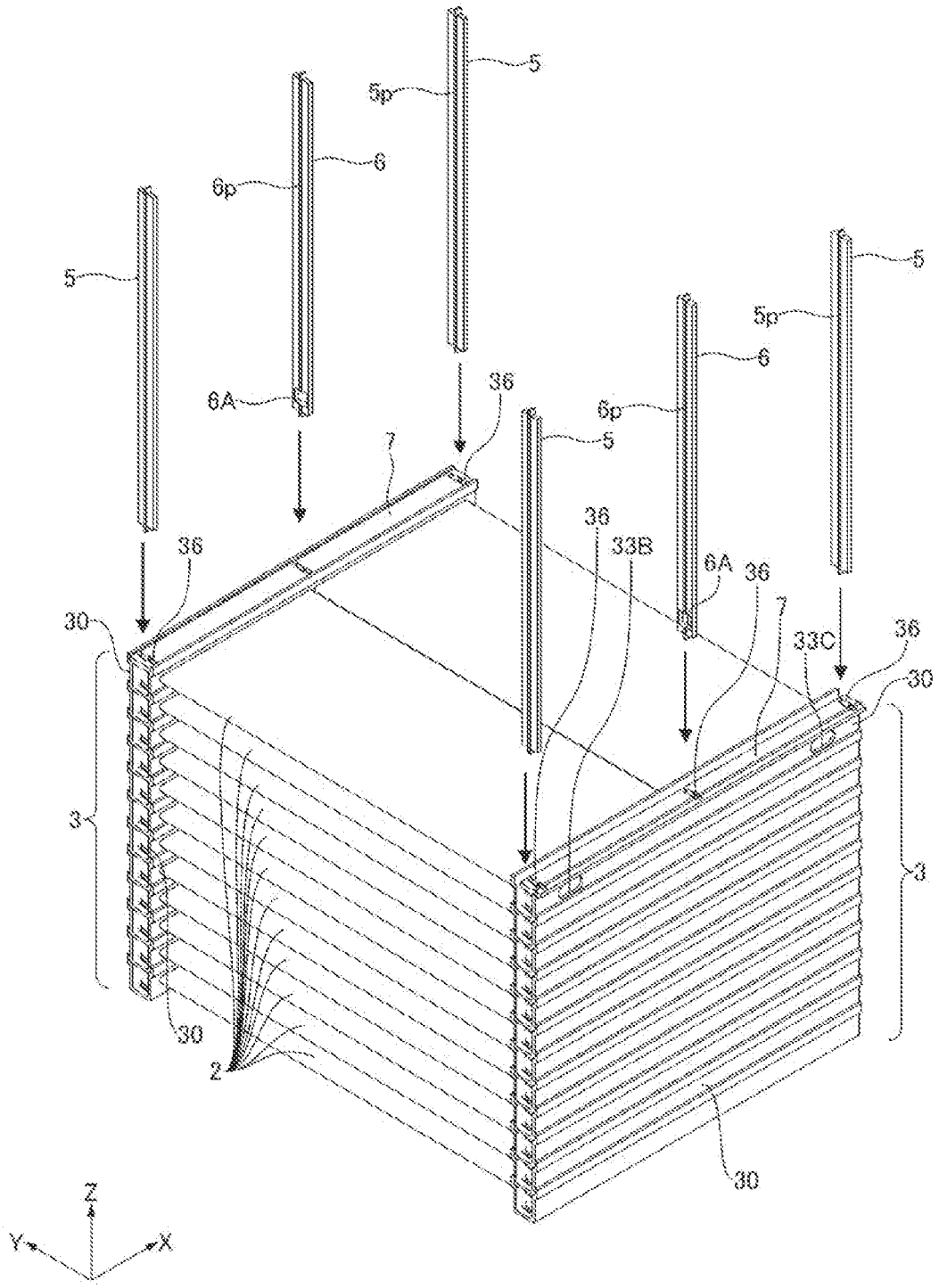
FIG. 8 illustrates an assembly of the heat exchanger (mounting of an insertion type caps, and insertion type partitions)
Figure 10A:
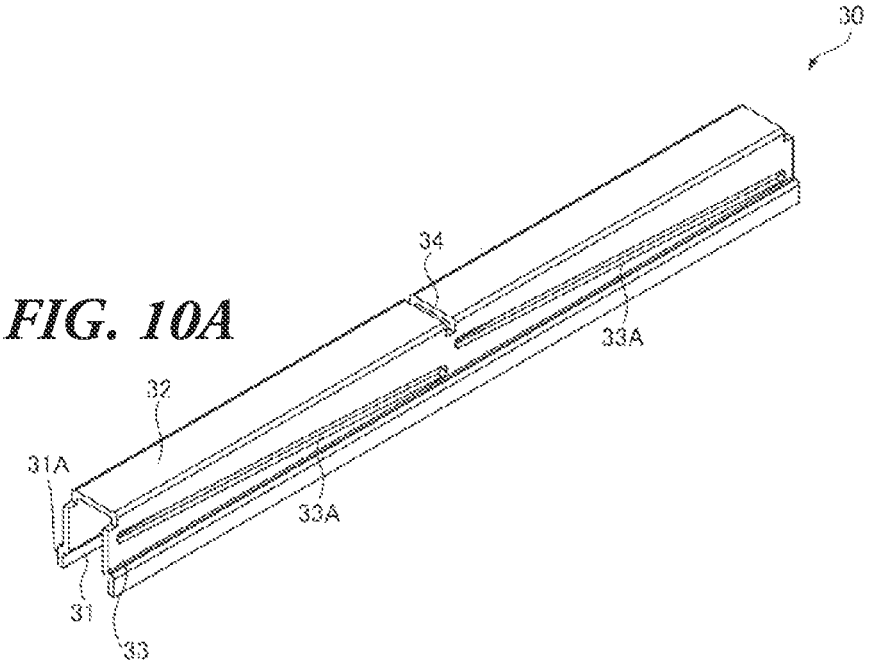
FIG. 10A is a cross-sectional view illustrating another configuration example of the header member.
Figure 10B:
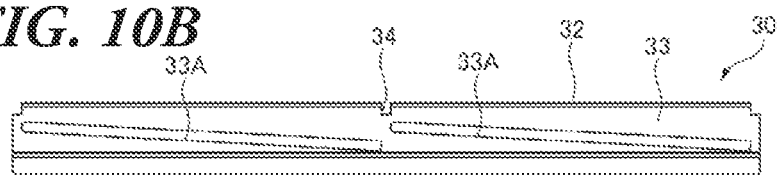
FIG. 10B is a side view illustrating another configuration example of the header member.
Figure 10C:
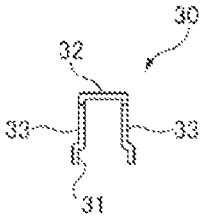
FIG. 10C is a front view illustrating another configuration example of the header member.
Figure 10D:
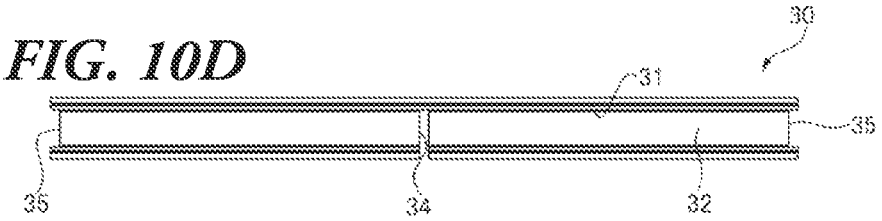
FIG. 10D is a bottom view illustrating another configuration example of the header member.

With the example illustrated in FIG. 7, the caps 5 and the partitions 6 are fitted in the header members 30 from the sides and therefore mounted to the header members 30. However, as illustrated in FIG. 8, insertion holes 36 arranged in series in the staking direction (the Z direction) are provided in the header members 30 and the header covers 7, and the caps 5 and the partitions 6 are inserted into the insertion holes 36, and therefore are mounted to the header members 30. In this case, as illustrated in FIG. 9, the cap 5 and the partition 6 include protrusions 5P and 6P protruding in the X direction, respectively, and the ends of the heat exchanger tubes 2 put to the protrusions 5P and 6P to position the heat exchanger tubes 2 for the fitting.

The heat exchanger tube 2 has a flat cross section which is long along the longitudinal direction of the header member 30. When the longitudinal direction of the flat cross section and the flow direction of the heat medium are orthogonal to the direction of the gravity, it makes it hard to smoothly discharge condensed water on the heat exchanger tubes 2 and rain water in outdoor use.

Figure 11:
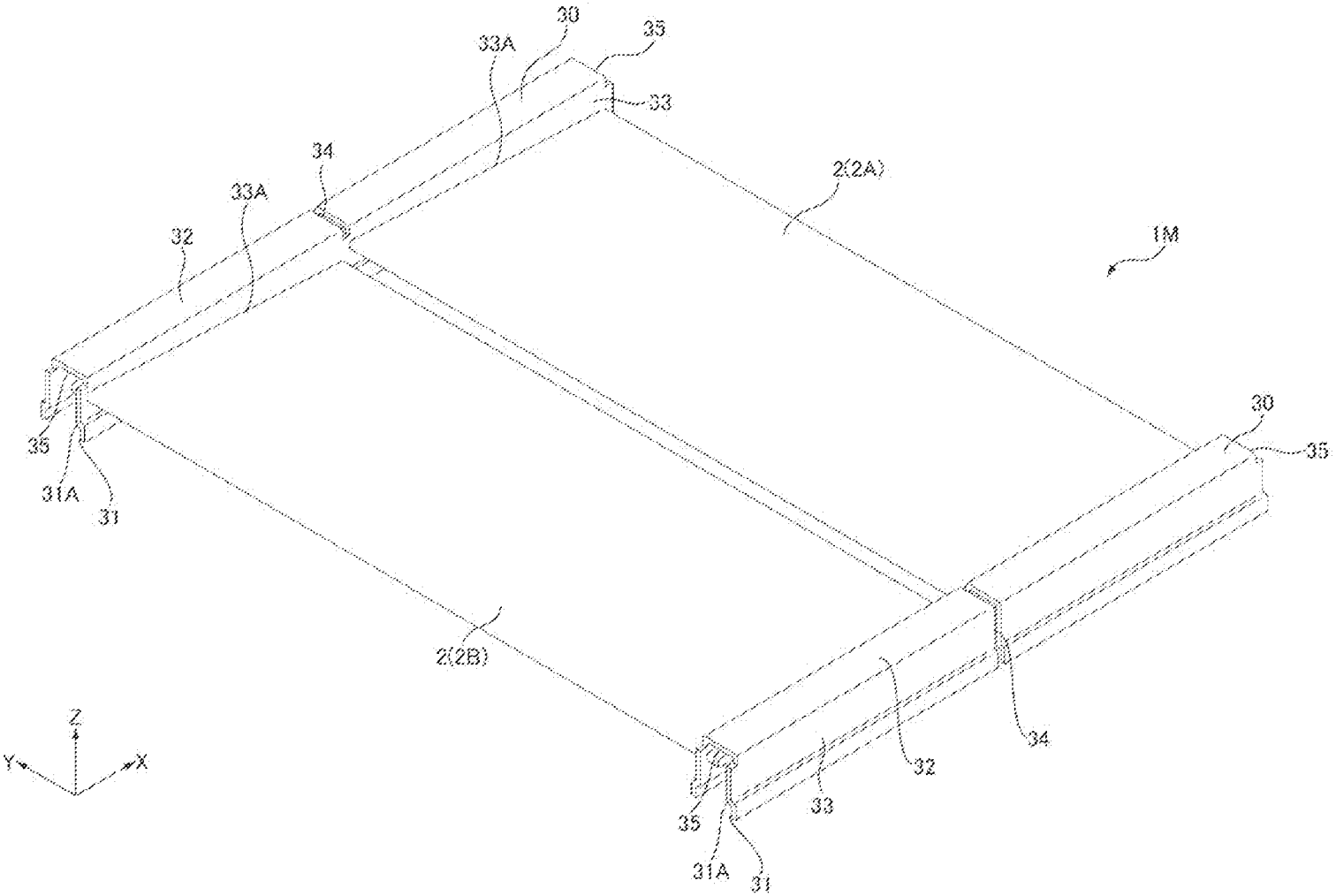
FIG. 11 illustrates another configuration example of one set of heat exchanger module.

To address this, as illustrated in FIG. 10, the fitted holes 33A are provided in the header member 30 in such a way that each of the fitted holes 33A has an angle of inclination with respect to the longitudinal direction of the header member 30. By this means, as illustrated in FIG. 11, one set of heat exchanger module 1M can be placed in a state where the surface of each of the heat exchanger tubes 2 is inclined with respect to the direction of the gravity. With the example illustrated in FIG. 10 and FIG. 11, two fitted holes 33A are parallel to one another in the longitudinal direction of the cross section across the width of the flat heat exchanger tube 2 (the width direction of the heat exchanger tube 2). However, the two fitted holes 33A are arranged in the directions to draw an inverted V-shape or a V-shape.

In this way, the heat exchangers 2 are provided with the inclination, and therefore the condensed water attached on the surfaces of the heat exchanger tubes 2 flows downward along the inclination in the direction of the gravity, and can be smoothly discharged. In addition, when the width direction of the heat exchanger tubes 2 is inclined with respect to the longitudinal direction of the header member 30, the length of each of the heat exchanger tubes 2 which are arranged along the longitudinal direction of the header member 30 can be increased by the inclination in the width direction. By this means, it is possible to widen the heat transfer area of the heat exchanger tubes 2, and consequently to widen the heat exchange area. By this means, it is possible to improve the heat exchange efficiency relative to the overall size of the heat exchanger while improving the water drainage.

The header member 30 illustrated in FIG. 12 is a modification of the example illustrated in FIG. 10, and includes the fitted holes 33A each of which is formed in an arc shape and is convex in the direction crossing the longitudinal direction of the header member 30. The surface of the heat exchanger tube 2 having a flat cross section is curved and fitted into the arc-shaped fitted hole 33A. By this means, it is possible to improve the heat exchange efficiency relative to the overall size of the heat exchanger, while improving the water drainage, in the same way as the above-described example. The heat exchanger tube 2 having an arc cross section can be manufactured by the extrusion.

Figure 13:
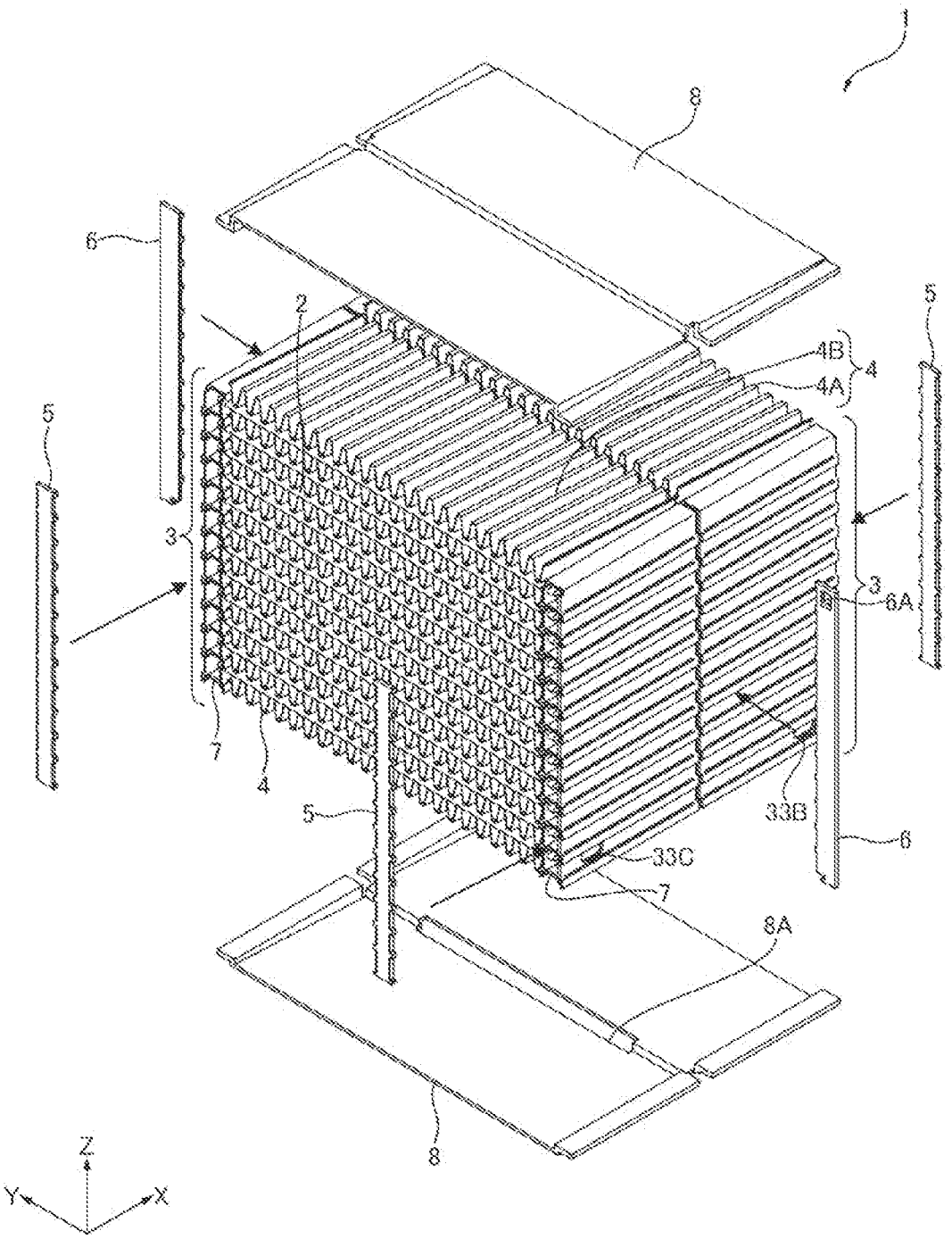
FIG. 13 illustrates the heat exchanger in which a plurality of heat exchanger modules illustrated in FIG. 11 are stacked.

FIG. 13 illustrates the heat exchanger 1 including the heat exchanger modules 1M (as illustrated in FIG. 11) stacked in the Z direction. With this example, the fin 4 is separated into two fins 4A and 4B, and the fins 4A and 4B are arranged on the two heat exchanger tubes 2 inclined with respect to the longitudinal direction of the header member 30. With the illustrated example, the two fins 4A and 4B are disposed on the two heat exchanger tubes 2 which are parallel to one another and inclined with respect to the longitudinal direction of the header member 30. However, when the two heat exchanger tubes 2 are inclined to draw an inverted V-shape, the fin 4 is folded to form an inverted V-shape and disposed on the two heat exchanger tubes 2. In addition, with the illustrated example, a drainage channel 8A is provided in the center of the lower side plate 8.

Figure 14:
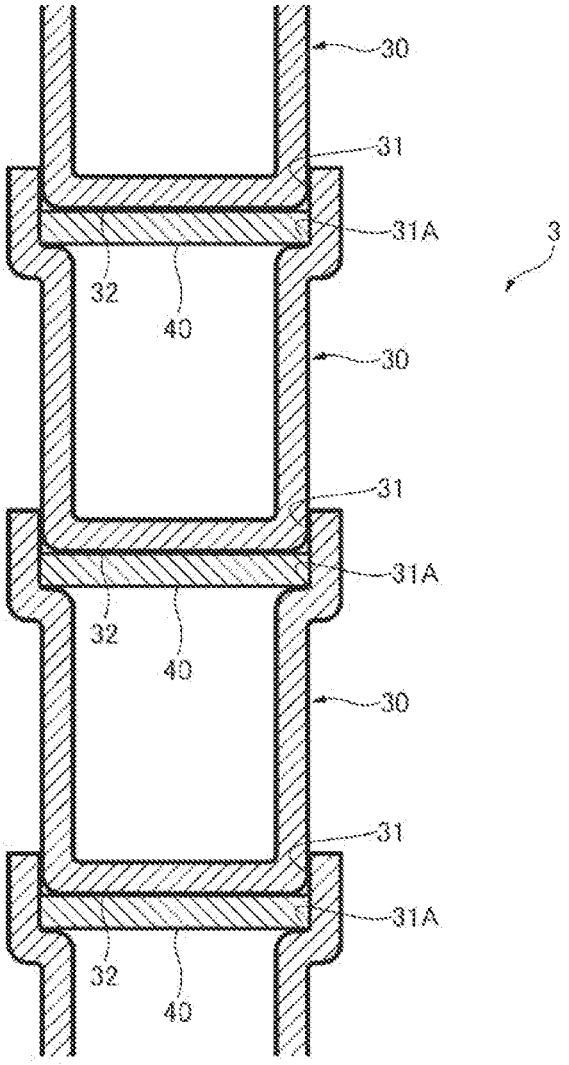
FIG. 14 illustrates a configuration example of the header.
Figure 15:
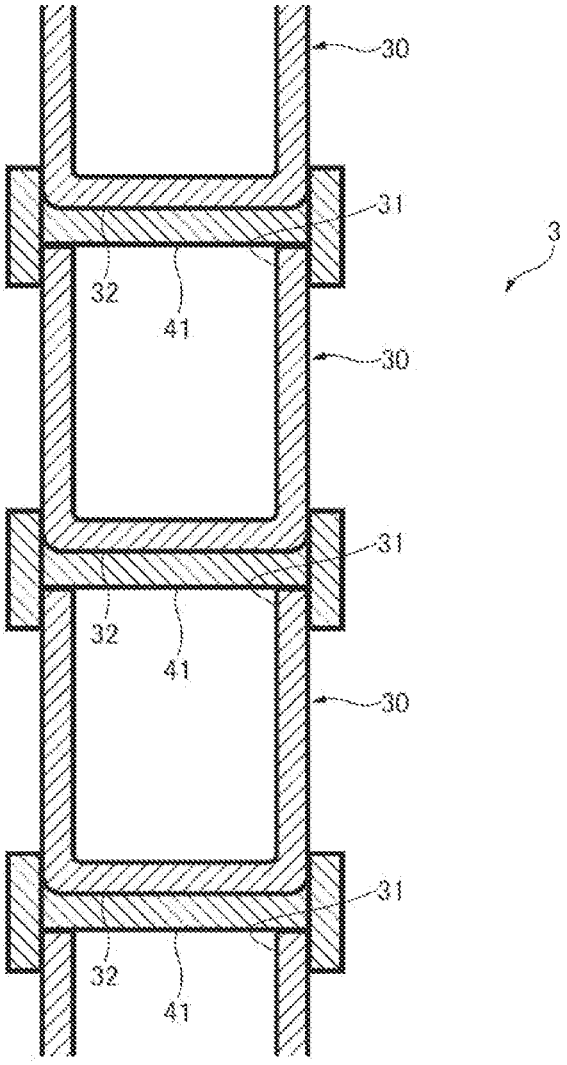
FIG. 15 illustrates a configuration example of the header.

Each of FIG. 14 and FIG. 15 illustrates another configuration example of the header 3. As described above, when the header members 30 are stacked to form the header 3, the communication portion 32A provided in the bottom part 32 of the header member 30 decreases the pressure strength of the header 3. However, when the header member 30 is formed of one metal plate having a constant thickness, it is difficult to solve this problem by increasing the thickness of only a specific part around the communication portion 32A, in view of production technology. Meanwhile, when it is tried to simply increase the thickness of the overall header member 30, the thickness of the part having a sufficient strength is increased. This causes a problem with unnecessarily increasing the weight and the cost.

FIG. 14 and FIG. 15 illustrate configuration examples to solve the above-described problems. The example illustrated in FIG. 14 adopts a structure in which a reinforcing communication plate 40 which is a plate member having a communication portion is sandwiched each between the stacked header members 30. The reinforcing communication plate 40 is set on the step portions 31A of the open part 31 of the header member 30, and the bottom part 32 of another stacked header member 30 is placed on the set reinforcing communication plate 40. Naturally, the communication portion (not shown) of the reinforcing communication plate 40 overlaps the communication portion 32A of the bottom part 32 of the header member 30 stacked thereon. Finally, the bottom part 32 of the header member 30, the open part 31, and the reinforcing communication plate 40 are integrally bonded to each other by brazing to form the header 3.

With the example illustrated in FIG. 14, the thickness of the part of the header member 30 which does not need to increase the strength is not increased, but the thickness of only the specific part of the communication portion which needs to increase the strength can be increased. By this means, it is possible to achieve a sufficient pressure strength of the overall header 3 while keeping an increase in the weight to the minimum necessary, without giving up the manufacturing cost, the processing cost, and the productivity.

The example illustrated in FIG. 15 adopts a structure in which the header member 30 does not include the step portions 31A of the open part 31 (and therefore has a simple U-shaped cross section), and a reinforcing communication member 41 including the communication portion and having an H-shaped cross section is sandwiched each between the stacked header members 30. Each of the corners of the surface of the reinforcing communication member 41 on which the bottom part 32 of the header member 30 is placed has an R-shape so as to closely contact the contour of the bottom part 32 of the header member 30. The reinforcing communication member 41 is configured to closely contact the bottom part 32 of the header member 30 on its upper side and closely contact the open part 31 of the header member 30 on its lower side. Finally, the bottom part 32 and the open part 31 of the header member 30 are integrally bonded to the reinforcing communication member 41 by the brazing to form the header 3.

With the example illustrated in FIG. 15, in the same way as the example illustrated in FIG. 14, the thickness of the part of the header member 30 which does not need to increase the strength is not increased, but the thickness of only the specific part of the communication portion which needs to increase the strength can be increased. By this means, it is possible to achieve a sufficient pressure strength of the overall header 3 while keeping an increase in the weight to the minimum necessary, without giving up the productivity. In addition, with the example illustrated in FIG. 15, the header members 30 are closely contact the reinforcing communication members 41. By this means, it is possible to eliminate gaps in which dew condensation water is accumulated, and therefore to prevent a risk of a failure such as puncture due to freezing.

Hereinafter, more specific example and modification of the heat exchanger 1 will be described. In the description below, the X, Y, and Z directions of arrows in the drawings are the same as described above, and the X direction denotes the longitudinal direction of the header member 30, the Y direction denotes the extending direction of the heat exchanger tube 2 (the flow direction of the heat medium), and the Z direction denotes the stacking direction of the heat exchanger modules 1M (the header members 30). Here, the components the same as those in the above-description are given the reference numbers the same as those in the above description, and duplicate description is omitted accordingly.

Figure 16:
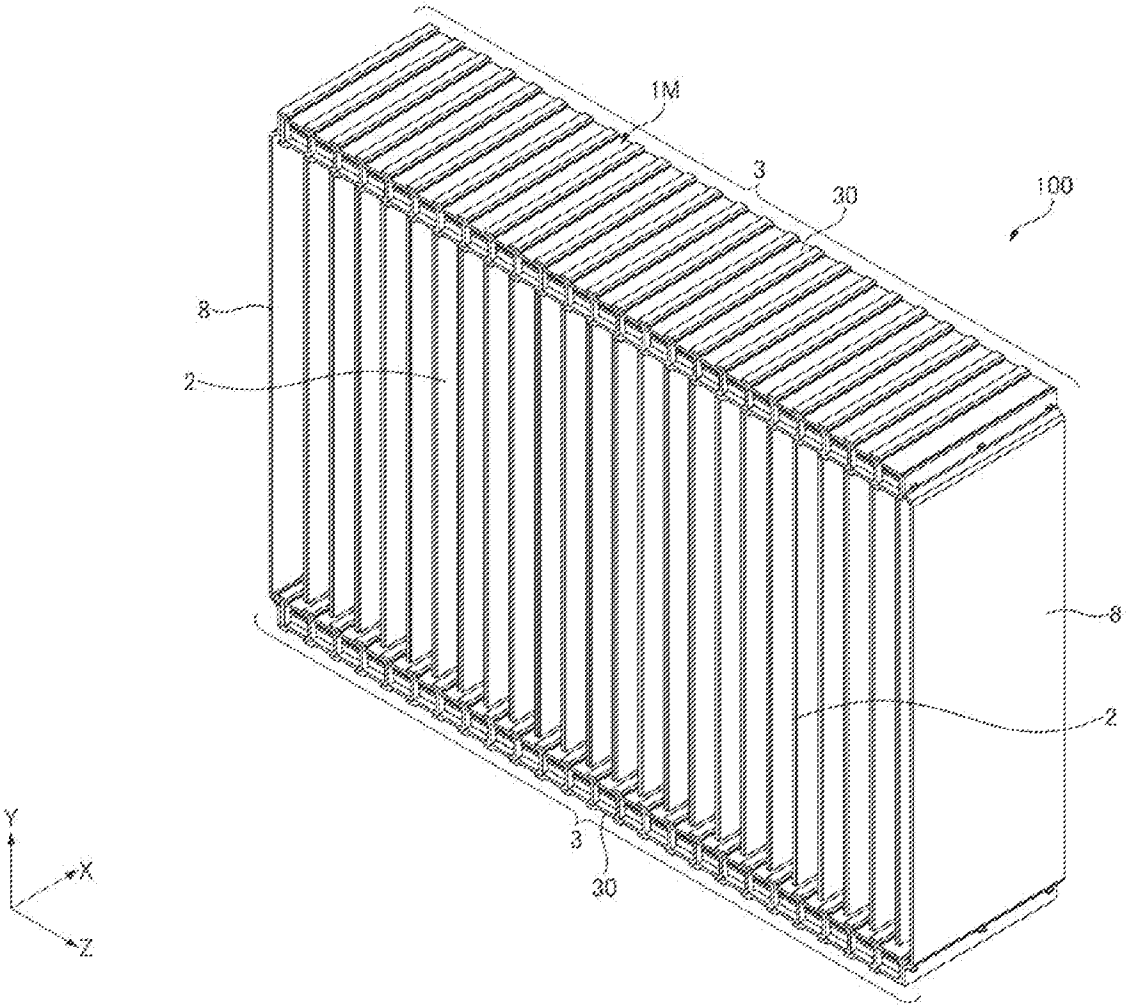
FIG. 16 is a perspective view illustrating an example of the heat exchanger.

A heat exchanger 100 illustrated in FIG. 16 is an example which can be applied to an evaporator, an indoor condenser, and a heater core. The heat exchanger 100 is configured to perform a heat exchange between the heat medium (refrigerant) flowing through the heat exchanger tubes 2 and the air passing through between the heat exchanger tubes 2, and has the direction of the gravity which is the extending direction of the heat exchanger tube 2 as the Y direction (the flow direction of the heat medium).

The flow of the heat medium through the header members 30 and the heat exchanger tubes 2 can be optionally set by installing the partitions and communication portions in the header members 30 in an appropriate manner.

Figure 17:
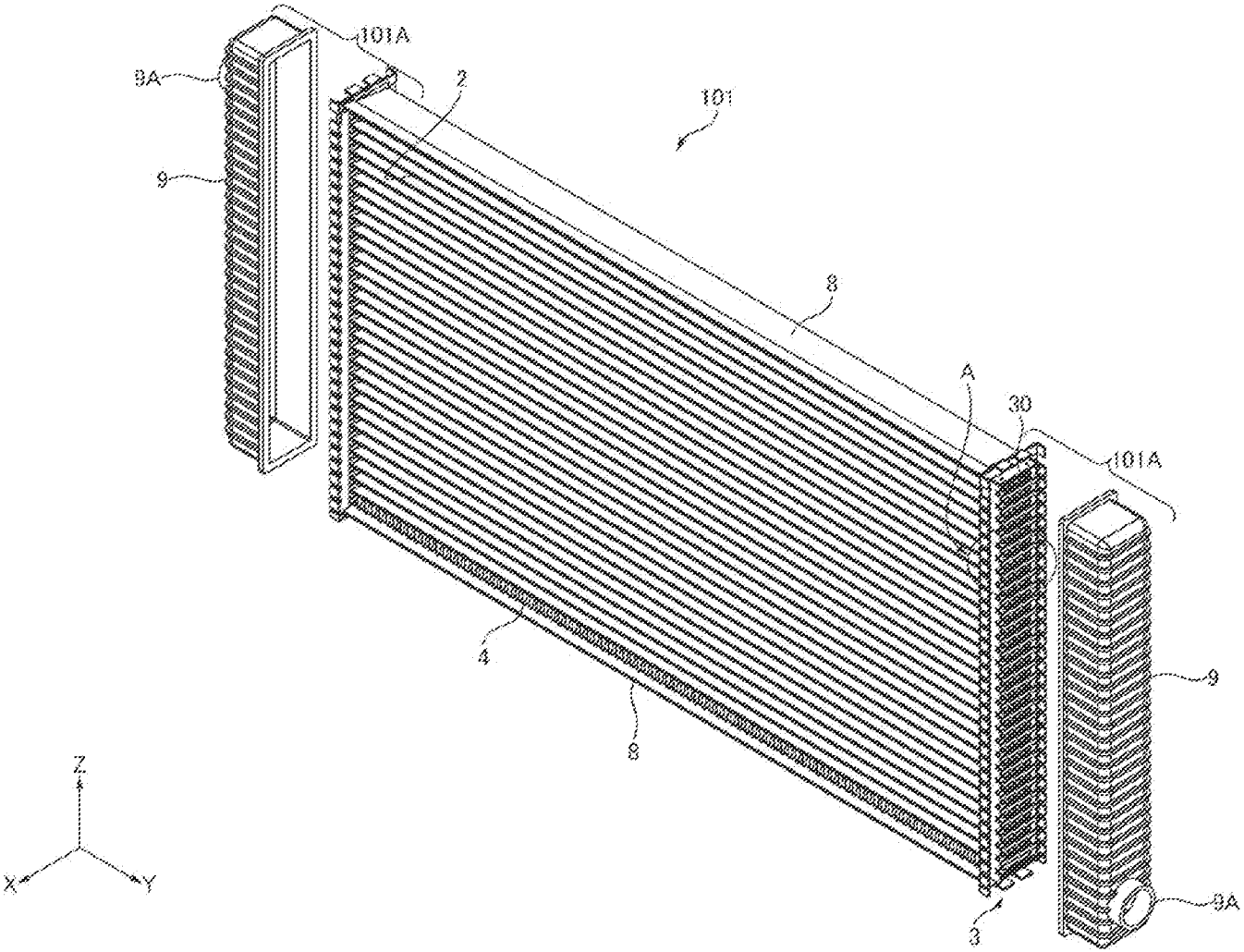
FIG. 17 is a perspective view illustrating an example of the heat exchanger.
Figure 17A:
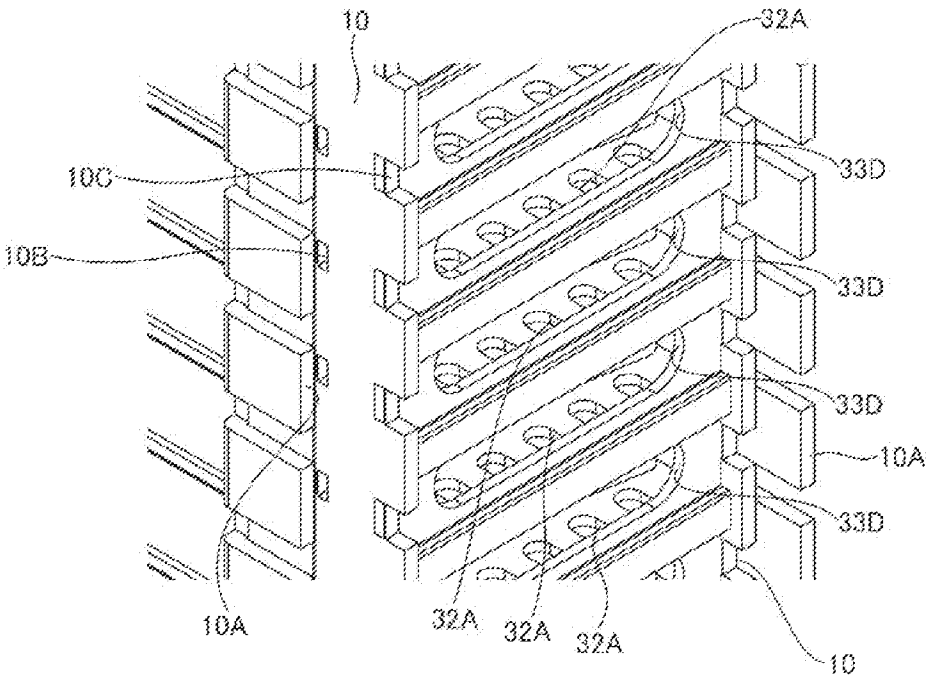
FIG. 17A is an enlarged view illustrating section A of FIG. 17.

A heat exchanger 101 illustrated in FIG. 17 is an example which can be applied to a radiator. The heat exchanger 101 is configured to perform a heat exchange between the heat medium (refrigerant) flowing through the heat exchanger tubes 2 and the air passing through between the heat exchanger tubes 2, and has the direction of the gravity which is the stacking direction of the header members 30. The heat exchanger tubes 2 of the heat exchanger 101 extend in the direction crossing the direction of the gravity, and are mounted to the header members 30 in such a way that the width direction of the flat heat exchanger tube 2 is inclined with respect to the longitudinal direction (the X direction) of the header member 30. The fins 4 are arranged appropriately in positions contacting the heat exchanger tubes 2 (between the heat exchanger tubes 2), but part of which is omitted in the drawing.

Figure 18:
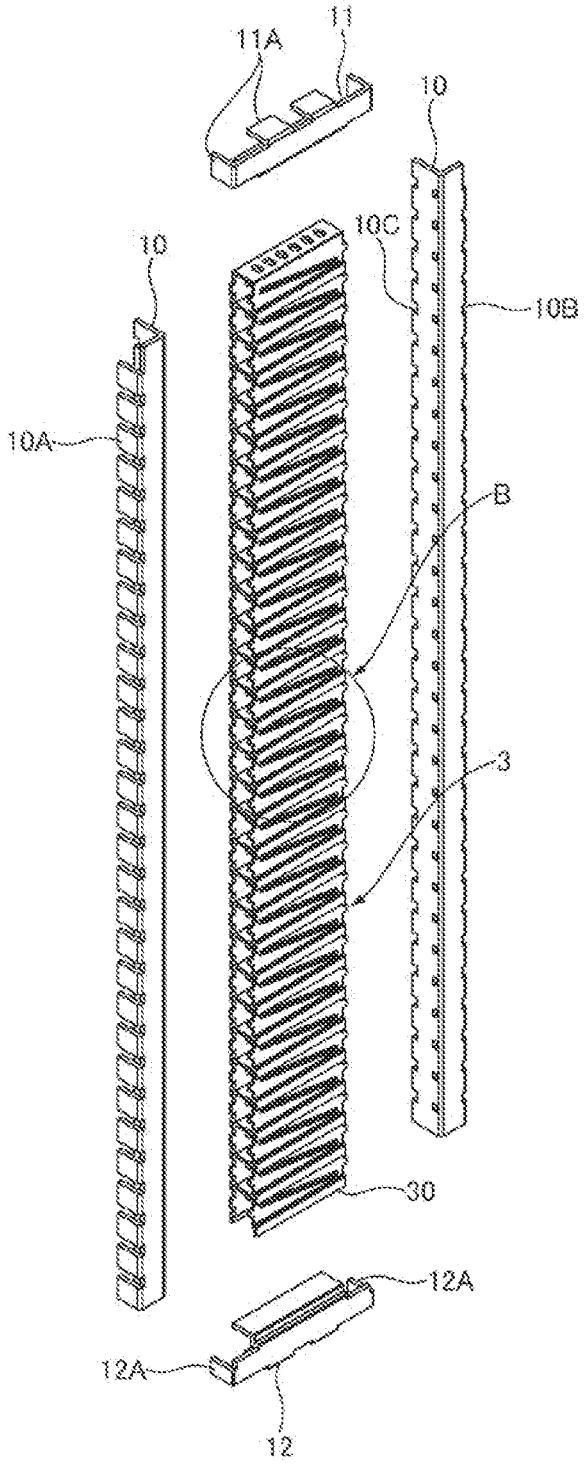
FIG. 18 illustrates the header of the heat exchanger illustrated in FIG. 17.
Figure 18A:
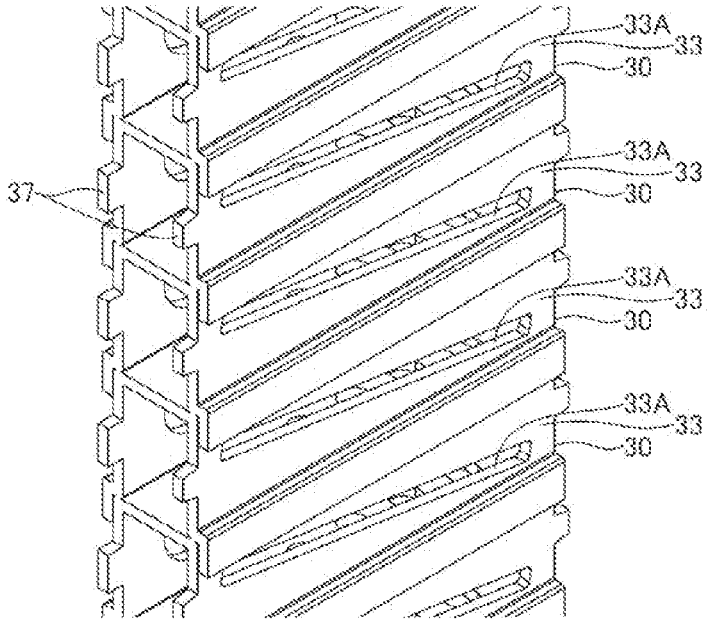
FIG. 18A is an enlarged view illustrating section B of FIG. 18.
Figure 19A:
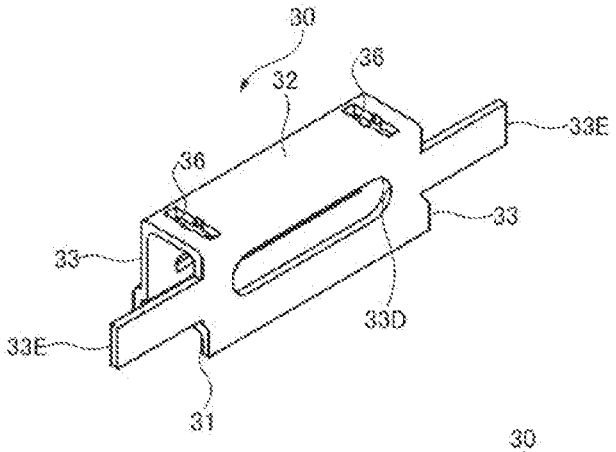
FIG. 19A is a perspective view illustrating another example of the header member.
Figure 19B:
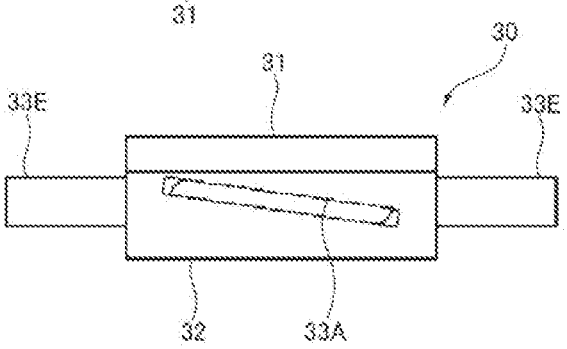
FIG. 19B is a front view illustrating another example of the header member.
Figure 19C:
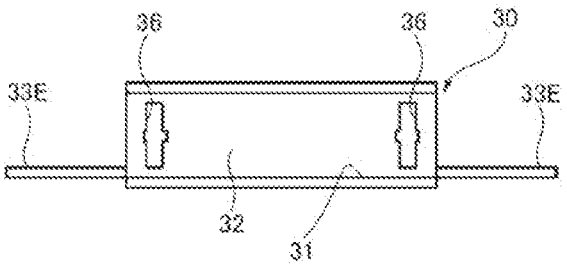
FIG. 19C is a plan view illustrating another example of the header member.
Figure 19D:
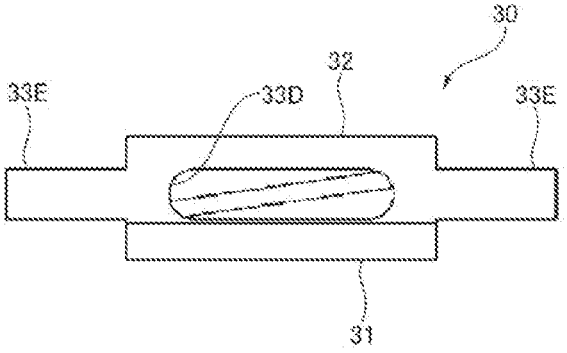
FIG. 19D is a rear view illustrating another example of the header member.

The heat exchanger 101 includes header units 101A provided on the right and left ends of the heat exchanger tubes 2. Each of the header units 101A includes a tank 9 having a heat medium entrance 9A, and also includes the header 3, side caps 10, an upper cap 11, and a lower cap 12 as illustrated in FIG. 18.

As described above, the header 3 has the structure in which the plurality of header members 30 are stacked. Each of the header members 30 includes the fitted hole 33A formed in one of the side parts 33, and a tank communication portion 33D configured to allow communication between the tank 9 and the header member 30 in the other of the side parts 33.

Each of the side caps 10 is a member to close the sides of the header members 30, and includes caulking claws 10A configured to join the tank 9, and fitted holes 10B and fitted grooves 10C into which fitting protrusions 37 protruding laterally from the header members 30 are fitted.

The upper cap 11 is mounted to the upper part of the header 3, and includes caulking claws 11A configured to join the tank 9. The lower cap 12 is mounted to the lower part of the header 3 to close the open part 31 of the bottom header member 30, and includes caulking claws 12A configured to join the tank 9.

The tank 9 is filled with the heat medium flowing into or flowing out of the header 3. One of the heat medium entrances 9A is a heat medium inlet configured to allow the heat medium to flow into the tank 9, and the other is a heat medium outlet configured to allow the heat medium to flow out of the tank 9. In the state in which the tank 9 is joined to the header 3, the parts of the header member 30 are built in the tank 9, except for the surfaces of the side parts 33 on which the fitted holes 33A are formed.

FIG. 19 illustrates a modification of the header member 30. The heat exchanger 101 illustrated in FIG. 18 includes the side caps 10, the upper cap 11, and the lower cap 12 with the caulking claws 10A, the caulking claws 11A, and the caulking claws 12A, respectively. However, the side part 33 of the header member 30 may include caulking claws 33E as illustrated in FIG. 19. In this case, the sides of the header members 30 are closed by inserting the caps 5 like flat plates as described above into the insertion holes 36.

Figure 20:
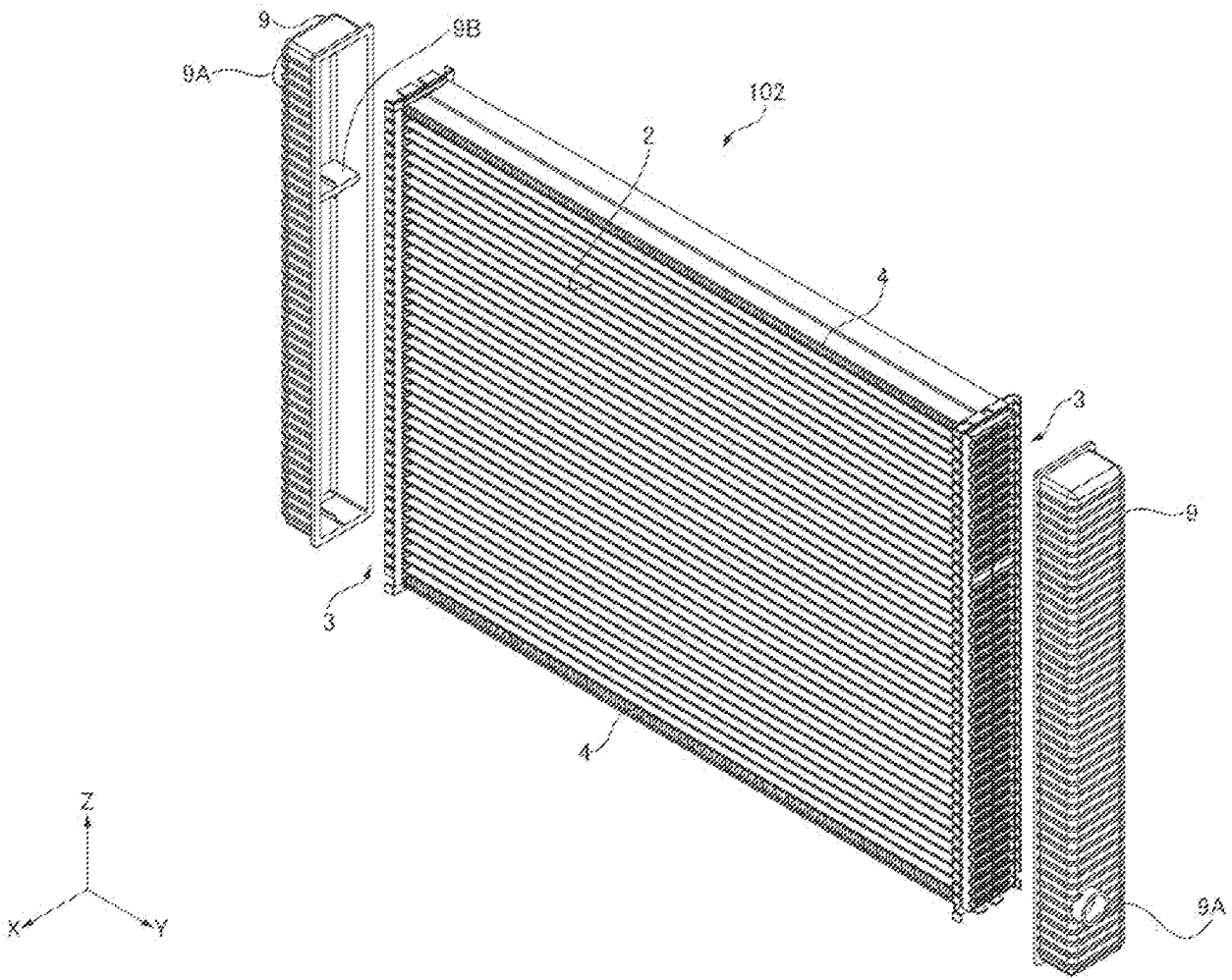
FIG. 20 is a perspective view illustrating an example of the heat exchanger.
Figure 21A:
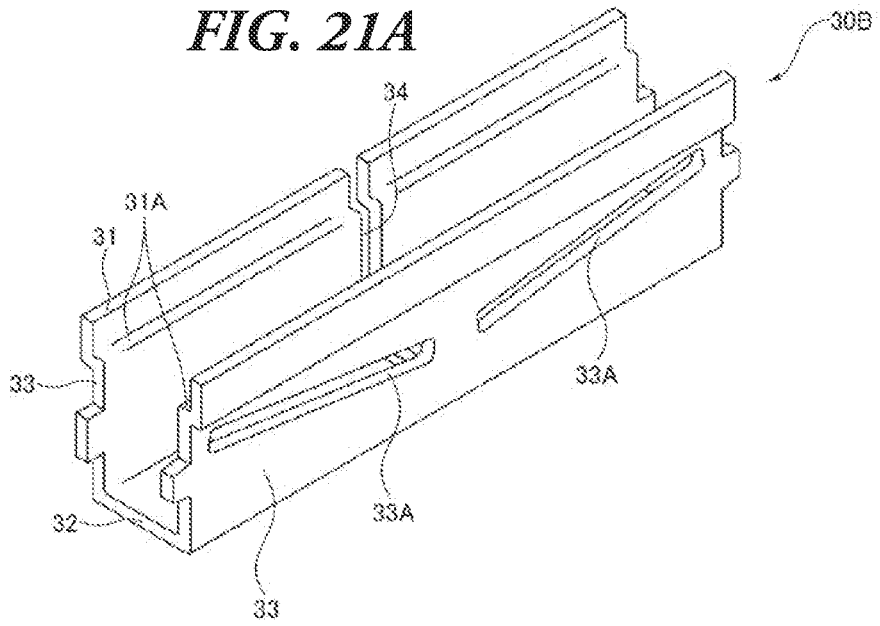
FIG. 21A illustrates a second header member used in the heat exchanger illustrated in FIG. 20.
Figure 21B:
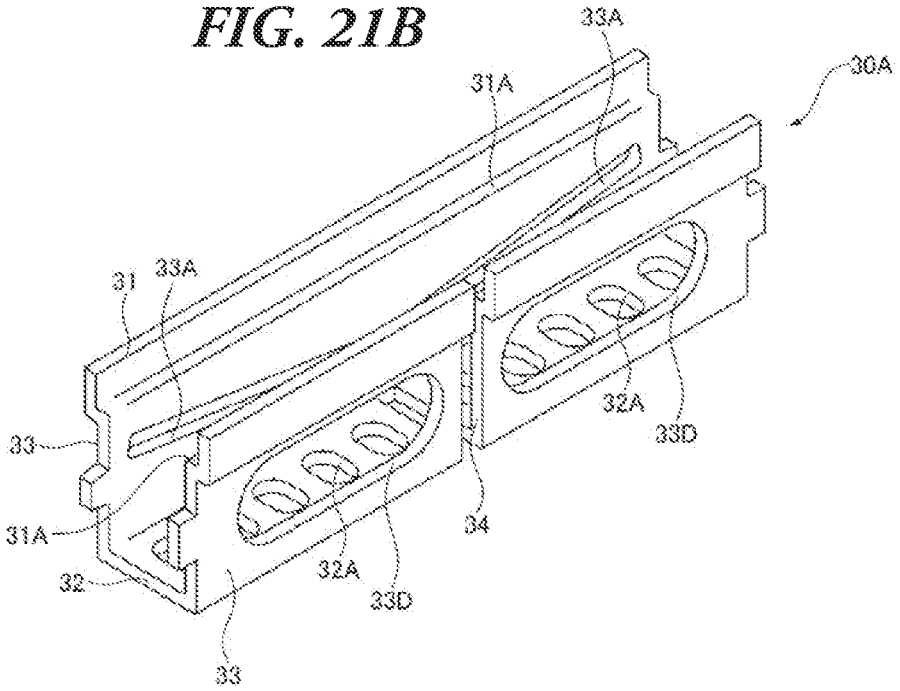
FIG. 21B illustrates a first header member used in the heat exchanger illustrated in FIG. 20.

FIG. 20 illustrates a modification of the example illustrated in FIG. 17. In a heat exchanger 102 illustrated in FIG. 20, the heat exchanger tubes 2 are arranged parallel to each other in the X direction. In the header 3 of the heat exchanger 102, a first header member 30A (FIG. 21B; 21(*b*)) and a second header member 30B (FIG. 21A; 21(*a*)) as illustrated in FIG. 21 are optionally selected and arranged depending on the set flow route of the heat medium.

The flow route of the heat medium in the heat exchanger 102 also is appropriately set by a partition 9B provided in the tank 9. The tank 9 may include not only a partition 9B configured to separate the interior of the tank 9 into the upper part and the lower part, but also a partition (not shown) configured to separate the interior of the tank 9 into the right part and the left part. The partition configured to separate the interior of the tank 9 into the right part and the left part is inserted into the partition groove 34 of each of the header members 30 thereby to separate the interior of the header member 30 in the extending direction of the header member 30.

In the heat exchanger 102, the fin 4 is disposed on two heat exchanger tubes 2 arranged parallel to one another.

As described above, in the heat exchanger 1 (100, 101, 102) according to the embodiments of the invention, the header 3 is constituted by stacking the header members 30. By this means, it is possible to decrease the headers 3 in size, regardless of the dimension of the heat exchanger tube 2 in the width direction, and therefore to enlarge the heat exchange area relative to the overall size of the heat exchanger 1 (100, 101, 102). In addition, it is possible to easily and optionally change the size of the heat exchanger 1 (100, 101, 102) by changing the number of the stacking of the header members 30. Accordingly, it is possible to easily adjust the size of the heat exchanger 1 (100, 101, 102) to fit the installation space.

In particular, the header members are coupled to the both ends of the heat exchanger tube 2, respectively, to form one set of heat exchanger module 1M, and the heat exchanger modules 1M are stacked to constitute the heat exchanger 1. By this modularization, it is possible to easily change the height of the heat exchanger 1 by simply changing the number of the stacking of the heat exchanger modules 1M.

Moreover, the open part 31 of the header member 30 includes the step portions 31A in which the bottom part 32 of another header member 30 closing this open part 31 is fitted. By this means, it is possible to improve the assembly efficiency when the header members 30 are stacked to assemble the heat exchanger 1, and make it easy to position the header members for the stacking.

Furthermore, the plurality of fitted holes 33A into which the ends of the heat exchangers 2 are fitted are provided in the side part 33 of the header member 30 along the longitudinal direction of the header member 30. By this means, the plurality of heat exchanger tubes 2 can be provided along the flow direction of the air. Furthermore, the header member 30 includes the partition groove 34 provided between the plurality of the fitted holes 33A, and the partition 6 to separate the interior of the header member is inserted into the partition groove 34. By this means, it is possible to provide a plurality of paths for heat exchange as the heat exchanger tubes 2. By this means, it is possible to increase the amount of heat exchange.

Here, the stacked header members 30 can provide various paths in the heat exchanger 1 by appropriately stacking the first header members 30A and the second header members 30B described above. The first header members 30A and the second header members 30B can be stacked not only alternately, but also optionally in combination, depending on a purpose such as reduction of pressure drop and equalization of the blowing temperature.

As described above, the embodiments of the present invention have been described in detail with reference to the drawings. However, the specific configuration is not limited to these embodiments, and the design can be changed without departing from the scope of the present invention. In addition, the above-described embodiments can be combined by utilizing each other's technology as long as there is no particular contradiction or problem in the purpose and configuration.

REFERENCE SIGNS LIST

10 1, 100, 101, 102: heat exchanger,
1M: heat exchanger module
2, 2A, 2B: heat exchanger tube,
3: header, 4: fin, 5: cap,
6: partition, 6A: communication port,
5P, 6P: protrusion,
7: header cover, 8: side plate,
9: tank, 9A: heat medium entrance, 9B: partition,
10: side cap, 10A: caulking claw,
10B: fitted hole, 10C: fitted groove,
11: upper cap, 12: lower cap,
30: header member, 30A: first header member,
30B: second header member,
31: open part, 31A: step portion,
32: bottom part, 32A: communication portion, 33: side part,
33A: fitted hole, 33B: heat medium inlet,
33C: heat medium outlet, 33D: tank communication portion
33E: caulking claw, 34: partition groove,
35: fitted part, 36: insertion hole,
37: fitting protrusion, 40: reinforcing communication plate,
41: reinforcing communication member

The invention claimed is:

1. A heat exchanger comprising:

a pair of headers; and a plurality of heat exchanger tubes stacked between the pair of headers, wherein:

each of the headers includes header members each having a gutter-shaped and approximately U-shaped cross section and including an open part and a bottom part;

the header members are stacked in a direction from the bottom part to the open part of each of the header members along a stacking direction of the heat exchanger tubes in such a way that the bottom part of one header member closes the open part of another header member; and a fitted hole into which an end of a heat exchanger tube is fitted is provided in a respective side part of each of the header members.

2. The heat exchanger according to claim 1, wherein the heat exchanger tube has a flat cross section which is longer along a longitudinal direction of the header members.

3. The heat exchanger according to claim 1, wherein the header members are coupled to respective ends of the heat exchanger tube to form one set of heat exchanger module, and a plurality of heat exchanger modules are stacked.

4. The heat exchanger according to claim 1, wherein the open part includes step portions in which the bottom part closing the open part is fitted.

5. The heat exchanger according to claim 1, wherein:

the open part of a bottom header member of the stacked header members is closed with a header cover; and ends of the bottom header member in the longitudinal direction are closed with caps extending in a stacking direction of the header members.

6. The heat exchanger according to claim 1, wherein:

a plurality of additional fitted holes are provided in the respective side parts of the header members along the longitudinal direction of the header members; and each of the header members include a partition groove provided between the additional fitted holes, and a partition configured to separate an interior of the header member is inserted into the partition groove.

7. The heat exchanger according to claim 1, wherein each of the fitted holes has an angle of inclination with respect to the longitudinal direction of the header member.

8. The heat exchanger according to claim 1, wherein each of the fitted holes is formed in an arc shape, and is convex in a direction crossing the longitudinal direction of the header member.

9. The heat exchanger according to claim 1, wherein:

the header member includes a first header member having the bottom part configured to separate between the stacked header members, and a second header member having a communication portion configured to allow communication between the stacked header members; and the header is constituted by optionally stacking the first header member and the second header member.

* * * * *